US006146205A

United States Patent [19]

Lai

[11] Patent Number: 6,146,205

[45] Date of Patent: Nov. 14, 2000

[54] CABLE CONNECTOR

[75] Inventor: Chin-Te Lai, Tao-Yuan, Taiwan

[73] Assignee: Hon Hai Precision Ind. Co., Ltd., Taipei Hsien, Taiwan

[21] Appl. No.: 09/370,385

[22] Filed: Aug. 9, 1999

[30] Foreign Application Priority Data

May 15, 1999 [TW] Taiwan ..... 88207779

[51] Int. Cl.[7] ..... H01R 9/03

[52] U.S. Cl. ..... 439/610; 439/358

[58] Field of Search ..... 439/607, 609, 439/610, 358, 357

[56] References Cited

U.S. PATENT DOCUMENTS

| | | | |
|---|---|---|---|
| 4,921,441 | 5/1990 | Sauder | 439/610 |
| 5,178,556 | 1/1993 | Chen | 439/357 |
| 5,199,897 | 4/1993 | Hashiguchi | 439/357 |
| 5,199,903 | 4/1993 | Asick et al. | 439/610 |
| 5,201,669 | 4/1993 | Lin | 439/357 |
| 5,244,415 | 9/1993 | Marsilio et al. | 439/610 |
| 5,505,637 | 4/1996 | Kramer et al. | 439/610 |
| 5,836,774 | 11/1998 | Tan et al. | 439/610 |

*Primary Examiner*—Gary F. Paumen
*Attorney, Agent, or Firm*—Wei Te Chung

[57] ABSTRACT

A cable connector comprises a contact subassembly, upper and lower shields, an outer housing and a latching mechanism including a pair of latch members and a pair of pressing members. The contact subassembly comprises an insulative housing having a front mating end, a shell enclosing the housing and a number of contacts of the same length received in the housing. A pair of cutouts is formed in opposite ends of the housing proximate the front mating end. A pair of transverse slots is formed in opposite ends of each extension plate of the shell proximate a main plate thereof. The lower shield comprises a pair of inwardly extending strips projecting from side walls thereof. The strips engage with the corresponding transverse slots of the shell and cutouts of the housing. Each latch member comprises a rear portion having a spring finger outwardly extending therefrom. The rear portion is press-fit into a pair of elongate grooves of the pressing member and a gap is defined therebetween.

4 Claims, 7 Drawing Sheets

CABLE CONNECTOR

BACKGROUND OF THE INVENTION

1. Field of the Invention

The present invention relates to a cable connector, and particularly to a cable connector for reliably connecting with a complementary connector to ensure proper signal transmission therebetween.

2. Description of Prior Art

A cable connector with a cable terminated to one end thereof is commonly used for interconnecting electronic components. Most notably, a cable connector is used to connect a computer to a peripheral device, such as a monitor, a printer or a CD-ROM drive.

U.S. Pat. No. 5,201,669 discloses a conventional cable connector 3 as shown in FIG. 1. The conventional cable connector 3 comprises an outer housing 30, a latching mechanism consisting of a pair of press-buttons 31 and a pair of clip pieces 32 coupled to the press-buttons 31, and a contact assembly 33 received in the outer housing 30. The contact assembly 33 comprises a contact subassembly 331 and a shell 332 enclosing the contact subassembly 331. The clip pieces 32 are hinged to the shell 332 of the contact assembly 33 and each comprises a leaf spring 321 with a pair of claw hooks 322 and an abutment arm 323 formed on opposite ends thereof. A U-shaped spring section 324 is formed between the abutment arm 323 and the leaf spring 321 for providing the clip piece 32 with resiliency. The abutment arm 323 is adapted for abutting against a side surface of the contact assembly 33 and the claw hooks 322 are adapted for locking to corresponding latch members of a complementary connector (not shown) with which the cable connector 3 is mated. When the press-buttons 31 are squeezed inward, the claw hooks 322 move away from each other thereby unlocking the cable connector 3 from the complementary connector.

However, since the clip pieces 32 are firmly fixed onto the press-buttons 31, an insufficient spring force for latching and unlatching operations is provided. Since only the spring section 324 provides the clip piece 32 with resiliency, the spring section 324 tends to yield after long term use due to metal fatigue thereof. Furthermore, while squeezing the press-buttons 31 for latching and unlatching the complementary connector to and from the cable connector 3, the press-buttons 31 may be easily damaged. U.S. Pat. Nos. 5,178,556, 5,199,897 and Taiwan Patent Application Nos. 77204597, 80205362 disclose pertinent latching mechanisms with the same problem.

FIG. 2 shows another conventional cable connector 4 as disclosed in Taiwan Patent Application No. 84206625. The cable connector 4 comprises a dielectric housing 41, a contact assembly 42 received in the housing 41 and a pair of opposite latching arms 43. The contact assembly 42 comprises a contact subassembly 421 and upper and lower shields 422, 423 enclosing the contact subassembly 421. The contact assembly 42 is received in a cavity 411 defined in the housing 41. Since no retention means is provided to retain the contact subassembly 421 within the shields 422, 423, the contact subassembly 421 may become improperly positioned in the housing 41 when connecting with / disconnecting from a complementary connector (not shown). Pertinent cable connectors with the same problem are disclosed in Taiwan Patent Application. Nos. 82217688 and 83107038.

A further conventional cable connector is disclosed in Taiwan Patent Application No. 84200820, wherein adjacent solder portions of a row of contacts are staggered and have different lengths for facilitating soldering thereof. Since the contacts have different lengths, signal integrity may be disrupted especially during high frequency signal transmission.

The present invention is directed at solving the above mentioned problems by providing a cable connector comprising retention means for retaining a contact subassembly in a shield member, a plurality of contacts having the same length and an improved latching mechanism.

SUMMARY OF THE INVENTION

Accordingly, one object of the present invention is to provide a cable connector having an improved latching mechanism providing reliable and durable resilient capabilities.

Another object of the present invention is to provide a cable connector with a contact subassembly securely retained in an outer housing thereof.

A further object of the present invention is to provide a cable connector having a plurality of contacts of the same length retained therein for maintaining signal integrity during transmission.

In order to achieve the objects set forth, a cable connector in accordance with the present invention comprises a contact subassembly, a shield member for shielding the contact subassembly, an outer housing for receiving the shielded contact subassembly, and a latching mechanism for disconnecting the cable connector from a complementary connector.

The contact subassembly comprises an insulative housing having a front mating end with a mating portion extending therefrom, a plurality of contacts received in the housing and a shell enclosing the housing. The contacts are of the same length thereby maintaining signal integrity during high frequency transmission. A pair of opposite cutouts is formed in opposite ends of the housing proximate a front mating end thereof. The shell comprises a main plate and a pair of opposite extension plates perpendicularly extending from the main plate. A pair of transverse slots is formed in each extension plate proximate the main plate and corresponding to the cutouts of the housing.

The shield member consists of upper and lower shields cooperatively profiled to enclose the contact subassembly. The lower shield has a pair of inwardly extending strips extending from front edges of opposite side walls for insertion into the corresponding slots of the shell and the corresponding cutouts of the housing thereby preventing forward and backward movement of the contact subassembly relative to the shield member.

The latching mechanism consists of a pair of latch members and a pair of dielectric pressing members fixed to the latch members. Each pressing member forms a channel therein and a pair of elongate grooves in internal upper and bottom sides thereof. Each latch member comprises a rear portion having an outwardly bent spring finger extending therefrom. The rear portion is press-fit into the elongate grooves of the pressing member and a gap is defined therebetween due to the provision of the spring finger. The latch member is provided with increased resiliency by the provision of the gap thereby preventing yielding of the latch member due to metal fatigue.

Other objects, advantages and novel features of the invention will become more apparent from the following detailed description when taken in conjunction with the accompanying drawings.

DETAILED DESCRIPTION OF THE INVENTION

Figure 1:
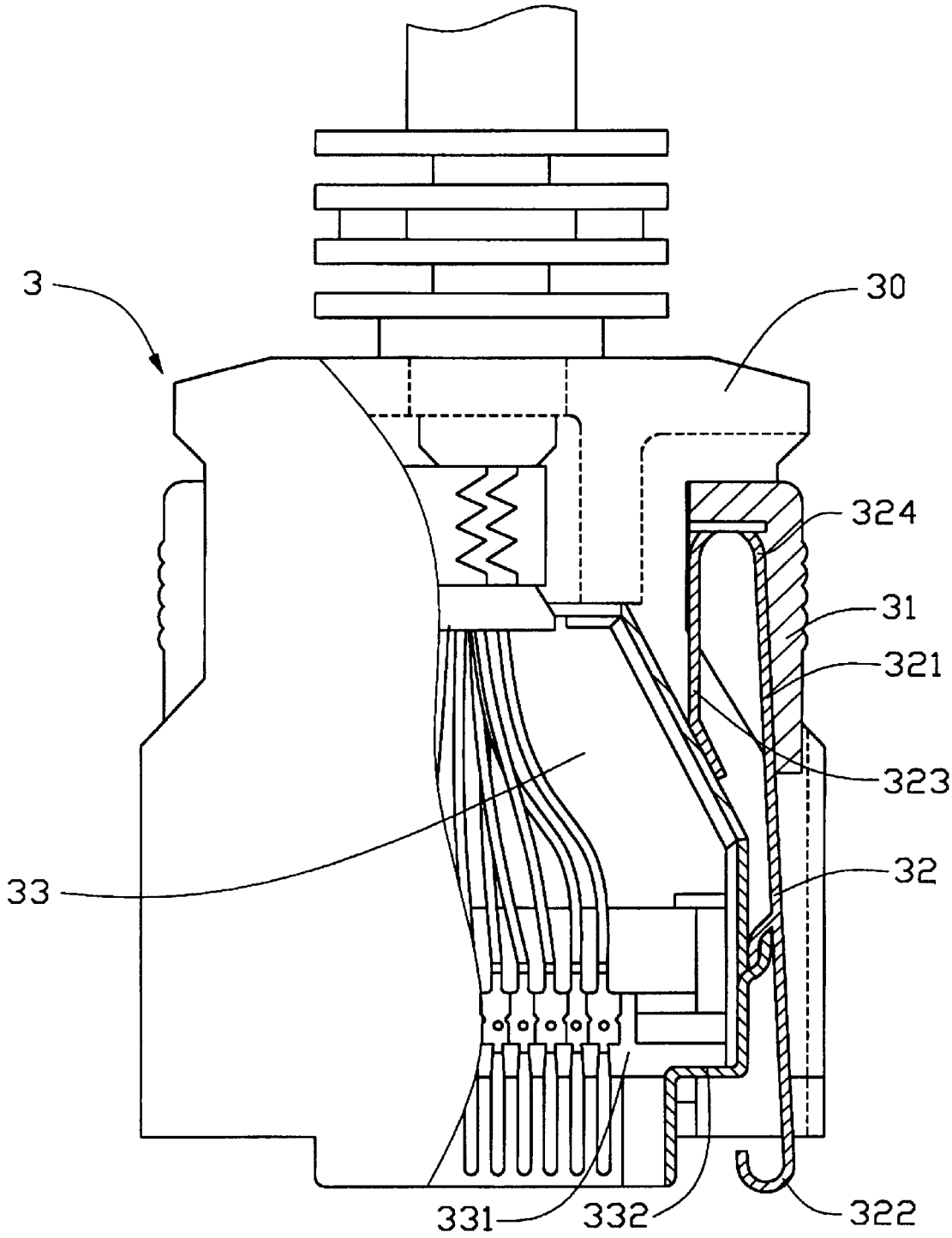
FIG. 1 (PRIOR ART)
FIG. 1 is a top planar view of a conventional cable connector partially cut away to show a latching mechanism retained therein.
Figure 2:
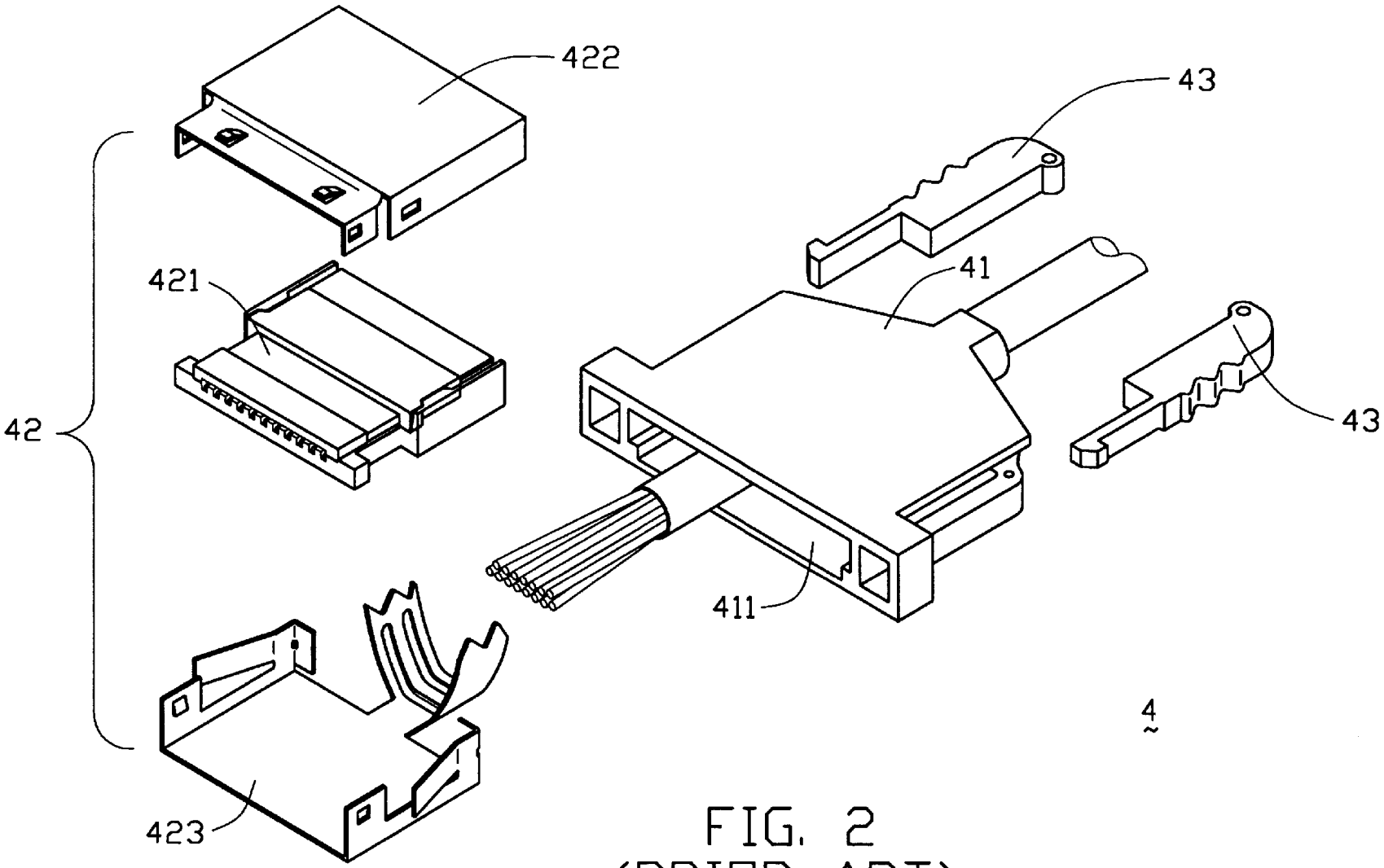
FIG. 2 (PRIOR ART)
FIG. 2 is an exploded view of another conventional cable connector.
Figure 3:
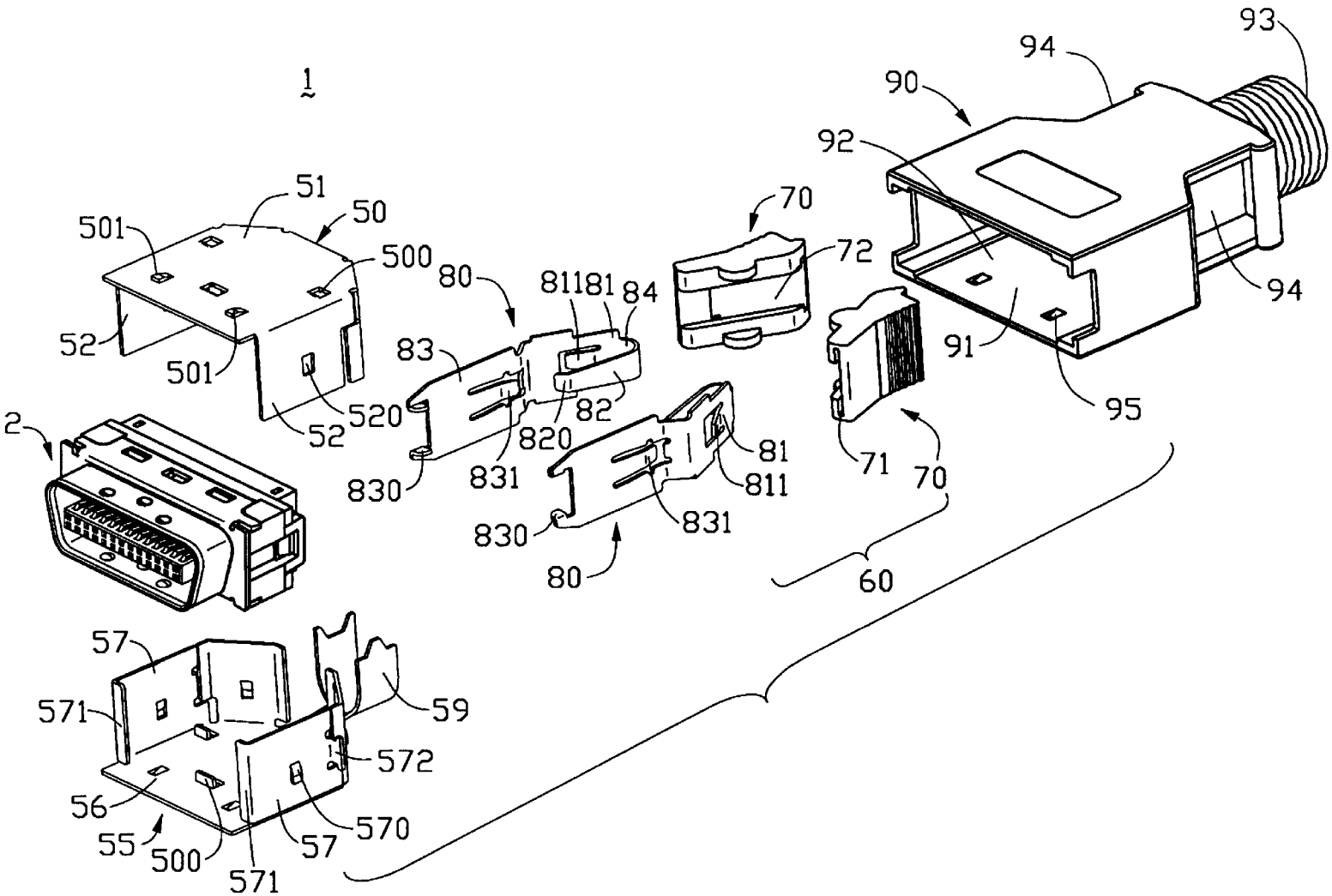
FIG. 3 is a partially exploded view of a cable connector in accordance with the present invention.

Referring to FIG. 3, a cable connector 1 in accordance with the present invention comprises a contact subassembly 2, a shield member consisting of upper and lower shields 50, 55 for shielding the contact subassembly 2, a latching mechanism 60 and an outer housing 90.

Figure 4:
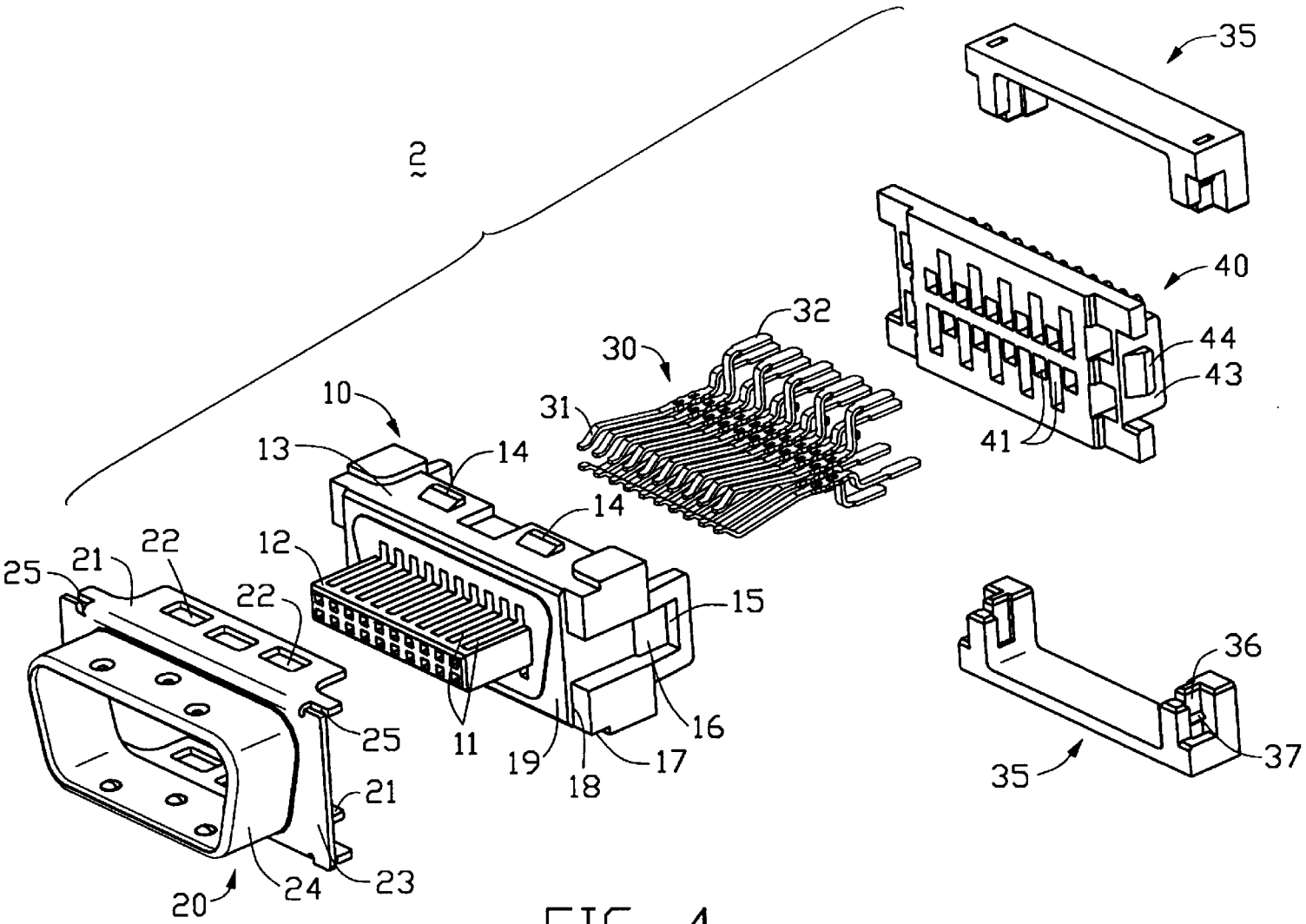
FIG. 4 is an exploded view of a contact subassembly shown in FIG. 3.

Referring to FIG. 4, the contact subassembly 2 comprises an insulative housing 10, a shell 20 for enclosing the housing 10, a plurality of contacts 30 received in the housing 10, a spacer 40 for retaining tail portions 32 of the contacts 30 in position and upper and lower spacer covers 35 attached to the spacer 40.

A plurality of passageways 11 arranged in two rows is defined through the housing 10 for receiving the corresponding contacts 30 therein. A mating portion 12 projects from a front mating end 19 of the housing 10 for mating with a complementary connector (not shown). A pair of bosses 14 extends from each upper and lower surface 13, 17 of the housing 10. A pair of cutouts 18 is formed in the front mating end 19 proximate opposite ends of the housing 10, the function of which will be described hereinafter. Alternatively, the cutouts 18 may be formed in opposite ends of the housing 10 proximate the front mating end 19. A pair of extension members 15 rearwardly extends from the opposite ends of the housing 10 each forming an engaging opening 16 therein.

The contacts 30 all have the same length and are arranged in two rows. Each contact 30 comprises a contact portion 31 retained in a corresponding passageway 11 of the mating portion 12 for mating with a corresponding contact of the complementary connector, and the tail portion 32 rearwardly extending from the housing 10. Adjacent tail portions 32 are staggered while maintaining the same length thereof thereby ensuring signal integrity especially during high frequency signal transmission.

The shell 20 comprises a main plate 23 with a hollow shroud 24 forwardly extending therefrom. A pair of extension plates 21 rearwardly extends from opposite longitudinal edges of the main plate 23. Each extension plate 21 forms a pair of openings 22 therein for engaging with the corresponding bosses 14 of the housing 10 thereby attaching the shell 20 to the housing 10 with the mating portion 12 received in the shroud 24. A pair of transverse slots 25 is formed in opposite edges of each extension plate 21 proximate the main plate 23, the function of which will be described hereinafter. Alternatively, the transverse slots 25 may be formed in opposite edges of each extension plate 21 adjacent to the main plate 23.

The spacer 40 comprises a plurality of staggered grooves 41 for engaging with and retaining the corresponding tail portions 32 of the contacts 30 in position. A pair of opposite side plates 43 rearwardly extends from the spacer 40 each forming an engaging tab 44 thereon for insertion into the corresponding engaging opening 16 of the extension member 15 of the housing 10. Each engaging tab 44 has a front inclined surface for facilitating engagement with the engaging opening 16 of the housing 10. Thus, the spacer 40 is securely attached to the opposite extension members 15 of the housing 10.

The spacer covers 35 are attached to upper and lower sides of the spacer 40 by a pair of opposite side portions 36. A triangular protrusion 37 is formed in each side portion 36 for insertion into a corresponding recess (not shown) formed in an inner surface of the side plate 43 of the spacer 40.

Figure 5:
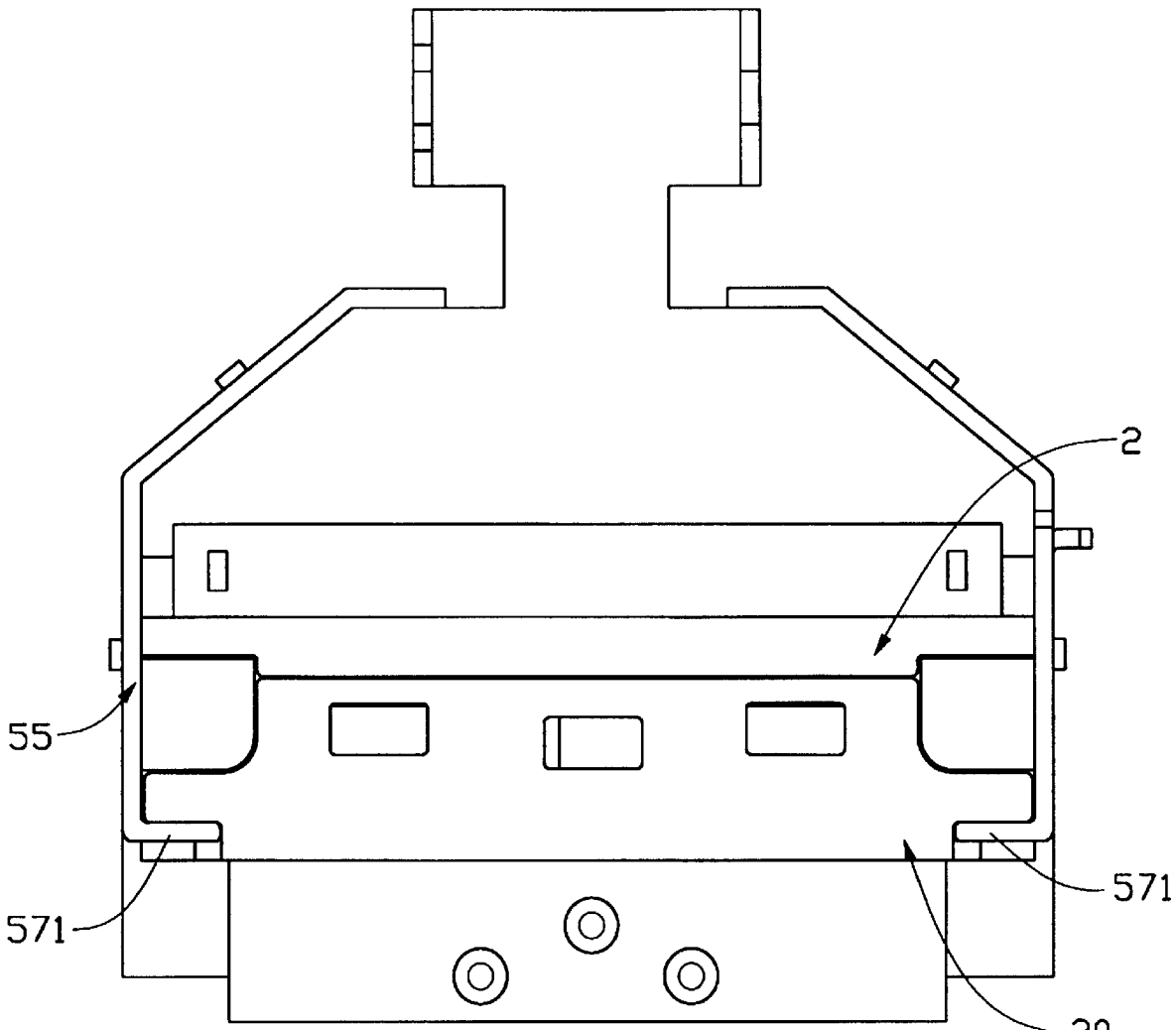
FIG. 5 is a top plan view of the contact subassembly positioned within a lower shield of the present invention.

Referring back to FIGS. 3 and 5, the upper and lower shields 50, 55 are adapted for enclosing the contact subassembly 2 and shielding the contacts 30 from EMI (electromagnetic interference). The lower shield 55 comprises a pair of strips 571 inwardly extending from front edges of opposite side walls 57 thereof. The contact subassembly 2 is positioned in the lower shield 55 with the strips 571 received in the corresponding transverse slots 25 thereof. Projections 570 extend outwardly from the side walls 57 of the lower shield 55 for insertion into corresponding holes 520 formed in side walls 52 of the upper shield 50 thereby latching the upper and lower shields 50, 55 together to form the shield member. Thus, forward and backward movement of the contact subassembly 2 relative to the shields 50, 55 is prevented due to the engagement between the transverse slots 25 of the contact subassembly 2 and the strips 571 of the lower shield 55. Alternatively, the strips 571 can be integrally stamped from each side wall 57 of the lower shield 55 proximate the front edge thereof corresponding to the configuration of the cutouts 18 of the contact subassembly 2.

A pair of outer lugs 501 extends from each base wall 51, 56 of the upper and lower shields 50, 55 for engaging with corresponding recesses 95 formed in the outer housing 90. Thus, the shields 50, 55 together with the received contact subassembly 2 are securely retained in an inner cavity 92 of the outer housing 90 through an opening 91 thereof. A plurality of inner lugs 500 extends from each base wall 51, 56 of the upper and lower shields 50, 55 for abutting against outer surfaces of the contact subassembly 2. The lower shield 55 further comprises an ear 572 extending from each side wall 57 thereof adjacent to the projection 570, and a crimp arm 59 for clamping onto a cable (not shown) terminated to the contact subassembly 2. The crimp arm 59 is received in a cylinder 93 of the outer housing 90.

The latching mechanism 60 consists of a pair of latch members 80 stamped from resilient metal material and a pair of dielectric pressing members 70 fixed onto the latch members 80. Each latch member 80 comprises a front portion 83, a rear portion 81 forming an obtuse angle with the front portion 83, a leaf spring 82 inwardly extending from the rear portion 81 toward the front portion 83, and a curved portion 84 interconnecting the rear portion 81 and the leaf spring 82. A pair of spaced hook members 830 is formed at a front end of each front portion 83 for latching onto a complementary latch arm (not shown) of the complementary connector. An inwardly extending cantilever 831 is stamped from the front portion 83. The rear portion 81 comprises an outwardly bent spring finger 811, the function of which will be described in detail hereinafter. A tongue 820 is formed on a free end of the leaf spring 82. Each pressing member 70 forms elongate grooves 71 therein through which the rear portion 81 of the latch member 80 is press-fit. A channel 72 is formed in the pressing member 70 in communication with the grooves 71 whereby the leaf spring 82 of the latch member 80 outwardly extends therefrom.

Figure 6:
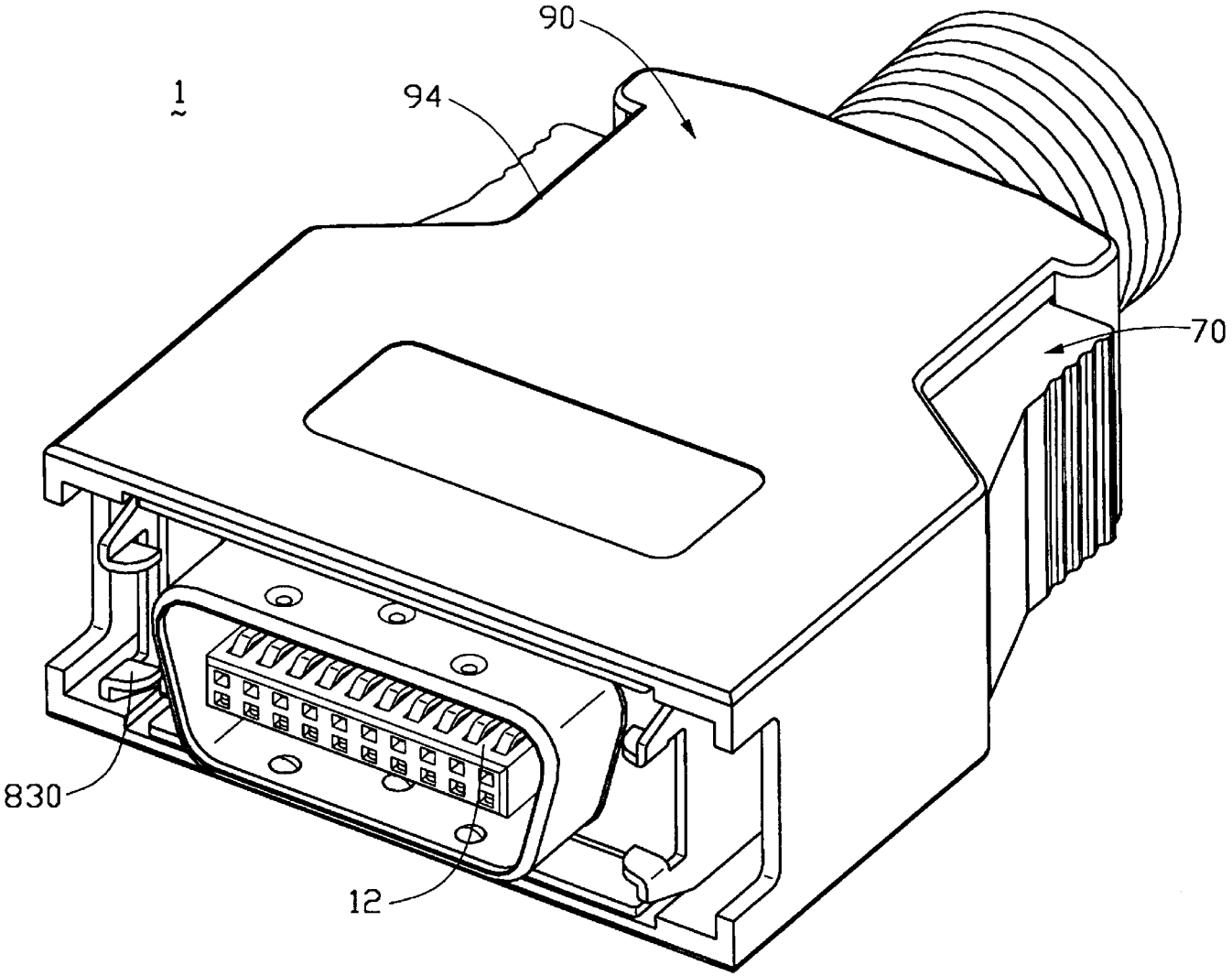
FIG. 6 is an assembled view of FIG. 3.

Also referring to FIG. 6, in assembly, the contact subassembly 2 with conductive wires (not shown) of the cable terminated to the respective tail portions 32 of the contacts 30 thereof is positioned within the lower shield 55 whereby the crimp arm 59 of the lower shield 55 clamps the cable. The strips 571 of the lower shield 55 are inserted into the corresponding transverse slots 25 of the shell 20 and the cutouts 18 of the housing 10 of the contact subassembly 2 thereby securely retaining the contact subassembly 2 in the lower shield 55. The upper shield 50 is cooperatively attached to the lower shield 55 whereby the inner lugs 500 of the upper and lower shields 50, 55 abut against outer surfaces of the contact subassembly 2. Thus, the contact subassembly 2 is securely retained between the upper and lower shields 50, 55.

The latching mechanism 60 is attached to opposite ends of the shielded contact subassembly 2 with the cantilevers 831 thereof abutting against the ears 572 of the lower shield 55. The outer housing 90 is moved along the cable to receive the shielded contact subassembly 2 in the inner cavity 92 thereof whereby the cable extends through the rear cylinder hole 93. The pressing members 70 of the latching mechanism 80 are disposed in side openings 94 of the outer housing 90 and the hook members 830 extend through the opening 91 of the outer housing 90. The outer lugs 501 of the upper and lower shields 50, 55 engage with the recesses 95 formed in inner surfaces of upper and bottom walls of the outer housing 90 to retain the outer housing 90 on the upper and lower shields 50, 55.

When the assembled cable connector 1 is mated with the complementary connector, the contact portions 31 of the contacts 30 thereof connect with corresponding contact portions and the hook members 830 thereof hook on complementary hook members thereby securely latching the connectors together. Squeezing the pressing members 70 of the latching mechanism 60 inward causes the front portions 83 of the latch members 80 to move away from each other thereby disengaging the hook members 830 from the complementary hook members so that the connectors can be disconnected.

Figure 7:
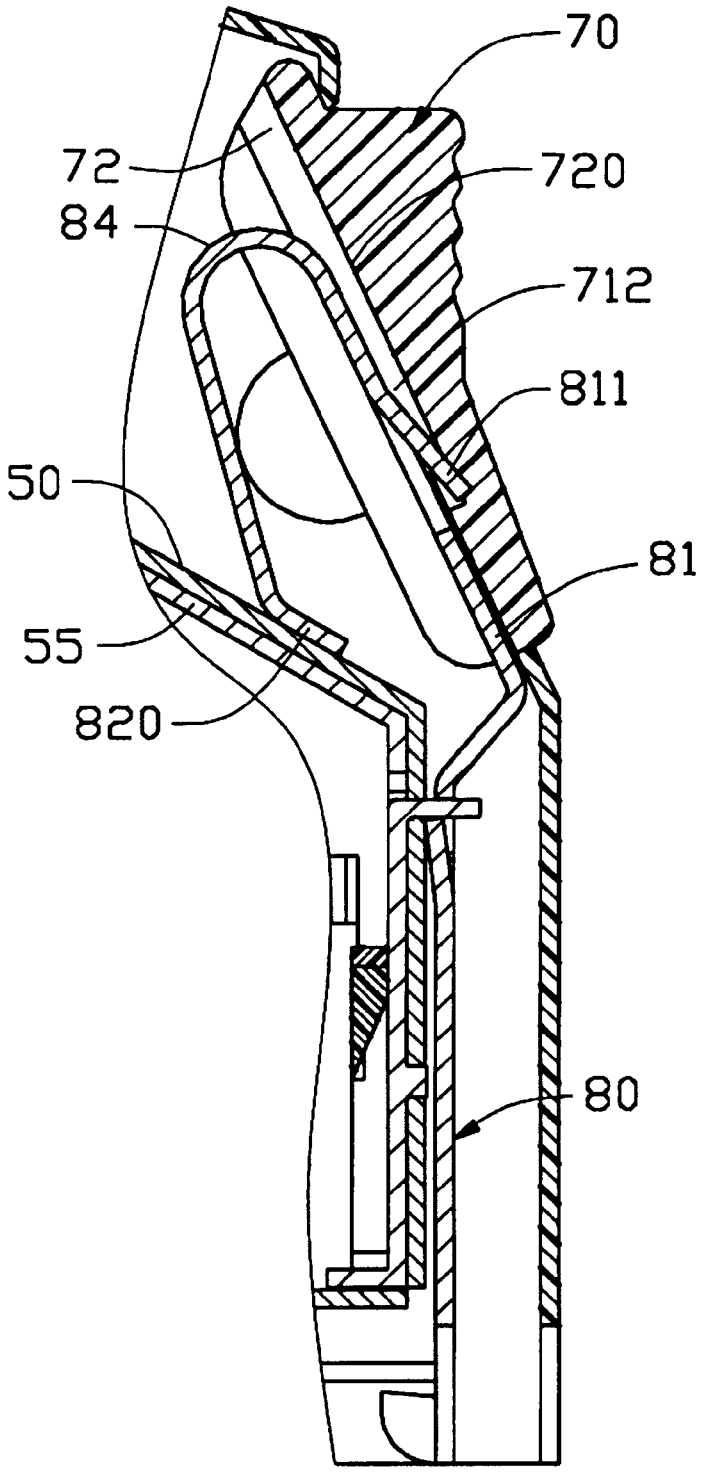
FIG. 7 is a partial cross-sectional view of FIG. 6 showing a latching mechanism of the present invention.

As shown in FIG. 7, a gap 712 is formed between the rear portion 81 of the latch member 80 and an inner bottom surface 720 of the channel 72 of the pressing member 70 due to the provision of the spring finger 811. The spring finger 811 inteferentially projects into the inner surface 720 of the pressing member 70. The tongue 820 of the leaf spring 82 abuts against an outer surface of the upper shield 50. When the latch member 80 is actuated, the gap 712 produced by the spring finger 811 provides the latch member 80 with increased resiliency. Thus, the curved portion 84 of the latch member 80 is prevented from yielding due to metal fatigue thereby ensuring accurate latching and unlatching after repeated operation.

The contact subassembly 2 is securely retained in the upper and lower shields 50, 55 due to the provision of the cutouts 18 of the housing 10, the transverse slots 25 of the shell 20 and the inwardly extending strips 571 of the shields 50, 55. Thus, forward and backward movement of the contact subassembly 2 relative to the shields 50, 55 when connecting with / disconnecting from the complementary connector is prevented. In addition, since the contacts 30 are the same length, signal integrity during high frequency signal transmission is maintained.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector for mating with a complementary connector, comprising:

a contact subassembly including an insulative housing defining a plurality of passageways, a plurality of contacts received in the passageways and a metal shell enclosing the housing, the housing having a front mating end and a pair of opposite cutouts formed proximate the front mating end, the shell comprising a main plate and a pair of opposite extension plates perpendicularly extending from the main plate, each extension plate having a pair of transverse slots formed in opposite ends thereof proximate the main plate and in communication with corresponding cutouts of the housing;

a metal shield member comprising an upper shield and a lower shield cooperatively attached together, the lower shield comprising a pair of opposite side walls, each side wall having an inwardly extending strip for engaging with corresponding transverse slots of the shell and a corresponding cutout of the housing to prevent forward and backward movement of the contact subassembly relative to the shield member; and an outer housing enclosing the contact subassembly and the metal shield member.

2. The cable connector as described in claim 1, wherein the strip inwardly extends from a front edge of each side wall of the lower shield.

3. The cable connector as described in claim 1, wherein the contacts have the same length for maintaining signal integrity during transmission.

4. A cable connector comprising:

a housing defining a plurality of passageways, a plurality of contacts received within the corresponding passageways, respectively;

a metal shell attached to the housing and comprising a main plate with a pair of opposite extension plates perpendicularly extending from opposite edges thereof, a pair of transverse slots formed in opposite ends of each of said extension plates; and a shielding member comprising a pair of side walls with a pair of strips respectively inwardly perpendicularly extending from front edges of the side walls and received within the corresponding transverse slots and retainably sandwiched between the main plate and the extension plates.

* * * * *